US006270019B1

(12) United States Patent
Reighard

(10) Patent No.: US 6,270,019 B1
(45) Date of Patent: Aug. 7, 2001

(54) APPARATUS AND METHOD FOR DISPENSING LIQUID MATERIAL

(75) Inventor: Michael A. Reighard, Avon Lake, OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/431,600

(22) Filed: Oct. 29, 1999

(51) Int. Cl.[7] ..... B05B 17/00
(52) U.S. Cl. ..... 239/1; 239/290; 239/423
(58) Field of Search ..... 239/105, 290, 239/291, 294, 418, 423, 1; 222/504, 509; 118/300, 303, 308, 63, 600

(56) References Cited

U.S. PATENT DOCUMENTS 4,031,854 6/1977 Sprague, Jr. .
4,346,849 8/1982 Rood .
4,349,947 9/1982 Rood .
5,017,409 5/1991 Bok .
5,397,058 * 3/1995 Zanetti ..... 239/290
5,747,102 5/1998 Smith et al. .

* cited by examiner

*Primary Examiner*—Lisa Ann Douglas
(74) *Attorney, Agent, or Firm*—Wood, Herron & Evans, LLP

(57) ABSTRACT

A liquid material dispensing system includes a nozzle assembly that is adapted to dispense a droplet of liquid or viscous material, such as solder flux or adhesive, onto a substrate. The nozzle assembly includes a liquid discharge passageway for dispensing the droplet, and an air discharge orifice for discharging a sheath of pressurized air. The sheath of pressurized air substantially surrounds the dispensed droplet and any satellite portions associated therewith during flight toward the substrate. The sheath of pressurized air advantageously contains the satellite portions within the discharged sheath to prevent them from falling onto areas of the substrate where it is undesirable to have a coating of liquid or viscous material. Methods for dispensing a droplet of liquid or viscous material onto a substrate are also disclosed.

15 Claims, 3 Drawing Sheets

APPARATUS AND METHOD FOR DISPENSING LIQUID MATERIAL

FIELD OF THE INVENTION

The present invention generally relates to apparatus for dispensing liquid or viscous materials and, more particularly, to an apparatus and method for dispensing droplets of liquid or viscous material onto a surface of a substrate.

BACKGROUND OF THE INVENTION

Liquid dispensing systems have become an integral part of the electronics manufacturing process for depositing underfill, encapsulants, solder fluxes, surface mount adhesives, conformal coatings and other materials onto a substrate, such as a printed circuit board. Each liquid dispensing system used in the electronics manufacturing process has a particular dispensing characteristic that is determined in large measure by the desired liquid dispense pattern on the substrate, the liquid flow rate and/or liquid viscosity of the dispensed material, and the desired electronic component assembly throughput through the dispensing system.

For example, in the assembly of ball gate arrays (BGA's) and other electronic components onto a ceramic or FR-4 substrate, the component must be soldered onto the substrate to form the necessary electrical interconnections. As each component occupies a predetermined area on the substrate, the liquid dispensing system must have the capability to dispense liquid or viscous material in a controlled manner within the selected component areas. Typically, the liquid dispenser is mounted on a movable platform to provide automated and accurate movement of the liquid dispenser in three dimensions relative to the substrate with the aid of a machine vision system.

Prior to the component soldering process for establishing the electrical interconnections, it is often necessary or at least desirable to dispense a layer of solder flux onto a substrate within rectangular areas associated with each component. To provide this capability, liquid material dispensers have been developed in the past that use filled syringes or reservoirs of solder flux, and dispensing valves to dispense droplets of flux material onto the substrate in a controlled manner with up to 25,000 to 40,000 dots of fluid per hour for a typical dispenser platform. These liquid dispensers, known as "dot jetting" dispensers, are programmed to dispense an array of liquid or viscous material droplets within each selected rectangular area which are then allowed to flow into contact with each other to form a generally rectangular thin layer of flux within the component area. "Dot jetting" dispensers are also used to dispense multiple droplets of adhesive onto a substrate to adhesively bond an electronic component to the substrate at a desired location.

In the "dot jet" process, each droplet of material is formed by rapidly closing a valve against a valve seat to impart kinetic energy to the fluid material within the dispenser. Closing of the valve causes the material to break off from the nozzle of the dispenser from which it is being dispensed and propel toward the substrate and onto the substrate as a droplet. Due to the high velocity imparted to form the jet or droplet of viscous material, the jet's tail may break into smaller droplets forming satellite portions associated with the main droplet. These satellite portions have a tendency to stray or deviate from the dispensing axis and cause problems when they hit the substrate outside of the area of the main droplet. The satellite portions may fall within areas of the substrate where it is undesirable to have a coating of viscous or liquid material, and may adversely affect the uniformity of the material coating applied to the substrate. As a result, the outlet of the "dot jetting" dispenser must typically be positioned relatively close to the substrate, such as in a range of about 1.5 mm to about 2.0 mm, to limit how far the satellite portions may deviate from the dispensing axis.

However, it will be appreciated that any reduction in the height of the nozzle tip relative to the substrate has a tendency to also reduce the size of droplet that may be dispensed onto the substrate since the droplet's ability to expand in flight toward the substrate is affected. This results in the need for more droplets of material to be dispensed to cover a given area of the substrate, and also results in increased dispense cycle times and reduced throughput of components through the dispenser.

Thus, there is a need for a liquid dispensing system that dispenses droplets of liquid or viscous material in a more accurate and repeatable manner. There is also a need for a liquid dispensing system that improves control of the dot shape and application of the dots toward a substrate. There is also a need for a liquid dispensing system that reduces dispense cycle times and improves throughput of components through the dispenser over known dispensing systems.

SUMMARY OF THE INVENTION

The present invention overcomes the foregoing and other shortcomings and drawbacks of liquid dispensing systems and methods heretofore known for forming and dispensing droplets of liquid or viscous material onto a substrate. While the invention will be described in connection with certain embodiments, it will be understood that the invention is not limited to these embodiments. On the contrary, the invention includes all alternatives, modifications and equivalents as may be included within the spirit and scope of the present invention.

The liquid dispensing system of the present invention is particularly adapted for dispensing a droplet of liquid or viscous material, such as solder flux or adhesive, onto a substrate. The dispensing system includes a nozzle assembly that is configured and adapted to dispense a droplet of liquid material, and also to discharge a sheath of pressurized air that substantially surrounds the dispensed droplet and any satellite portions associated therewith during flight toward the substrate. The sheath of pressurized air is operable to contain the satellite portions within the discharged sheath to prevent them from falling onto areas of the substrate where it is undesirable to have a coating of liquid or viscous material. In this way, the height of the dispenser outlet can be increased, such as to about 2.00 mm or greater, without adversely affecting the dispensed pattern of dots.

More particularly, the nozzle assembly includes a liquid dispensing nozzle body that is adapted to be connected to a dispenser body of a liquid dispenser. The liquid dispensing nozzle body includes a liquid discharge passageway in fluid communication with the liquid dispenser for dispensing the droplet of liquid or viscous material toward the substrate. An air discharge body is operatively connected to the liquid dispensing nozzle body and includes an air discharge orifice for discharging the sheath of pressurized air. The air discharge orifice is configured and located relative to the liquid discharge passageway to discharge the sheath of pressurized air so that the sheath substantially surrounds the dispensed droplet and any satellite portions associated therewith during flight toward the substrate to contain the satellite portions within the discharged sheath.

In one aspect of the present invention, the liquid discharge passageway and the air discharge orifice are co-axially aligned with one another. The air discharge orifice may be an annular orifice that surrounds the liquid discharge passageway. The air discharge body includes a plenum connected to the air discharge orifice. The air discharge body may have multiple radially directed vanes disposed in the plenum for guiding pressurized air flow through the plenum.

The present invention also contemplates a method for dispensing a droplet of liquid or viscous material onto a substrate. The method generally involves dispensing a droplet of material from a liquid discharge passageway that tends to separate into a droplet and at least one satellite portion during flight toward a substrate. Pressurized air is discharged as a sheath from an air discharge passageway so that the droplet and the satellite portion associated therewith are substantially surrounded by the discharged sheath during flight toward the substrate. The discharged sheath of pressurized air is operable to contain the satellite portion within the sheath.

Accordingly, the present invention provides an apparatus and method for accurately and reliably dispensing a droplet of liquid or viscous material onto a substrate. With the sheath of pressurized air surrounding the droplet and its associated satellite portions during flight toward the substrate, better control of the dot shape and application of the dots toward the substrate is achieved. Further, the method and dispensing apparatus of the present invention permit higher dispense heights than previously achieved by known material dispensing systems, thereby allowing greater material coverage on the substrate with fewer dots.

Various additional advantages, objects and features of the invention will become more readily apparent to those of ordinary skill in the art upon consideration of the following detailed description of the presently preferred embodiment taken in conjunction with the accompanying drawings.

DETAILED DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF PREFERRED EMBODIMENT

Figure 1:
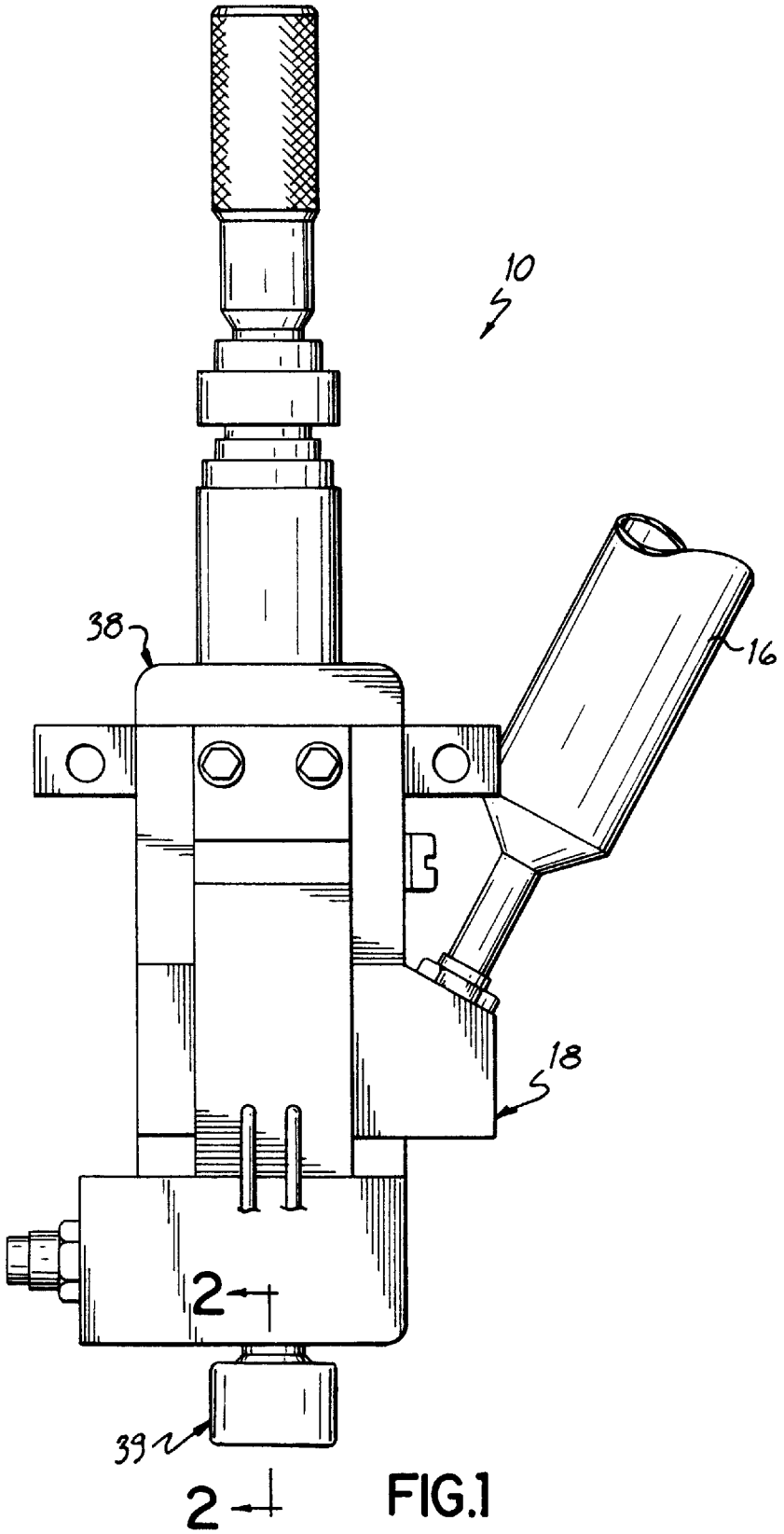
FIG. 1 is a side elevational view of a liquid dispensing system in accordance with the principles of the present invention for dispensing a droplet of viscous material toward a substrate.

With reference to the figures, a liquid dispensing system 10 for dispensing a droplet 12 of liquid or viscous material onto a substrate 14 (FIGS. 4A–4B) such as a printed circuit board is shown in accordance with the principles of the present invention. Liquid dispensing system 10 includes a standard, commercially available syringe 16 filled with liquid or viscous material, such as solder flux, surface mount adhesive, epoxy or other material, that is fluidly connected to a housing 18 of the dispensing system 10. While not shown, it will be appreciated that syringe 16 could be replaced with a typical fluid material reservoir as known in the art. As will be appreciated by those skilled in the art, housing 18 includes an elongated flow bore 20 (FIG. 2) that forms a flow passage 22 generally aligned with a longitudinal axis of the dispensing system 10. Flow passage 22 fluidly communicates at one end with an output of syringe 16, and at the other end with an outlet end 24 of the dispensing system 10 from which the pressurized liquid or viscous material is dispensed as will be described in detail below.

An air tube (not shown) is connected to a pressure regulator (not shown) and a source of low pressure air (not shown). The air tube (not shown) has one end connected to an inlet (not shown) of syringe 16 to force the liquid or viscous material, typically having a viscosity of between about 20 and about 3,000,000 centipoise, into flow passage 22 of dispensing system 10 at a constant pressure between about 4 PSI and about 30 PSI. While not shown, it will be appreciated that liquid dispensing system 10 is mounted on a movable platform for moving the dispensing system 10 in a controlled manner relative to the substrate 12. For a more detailed description of the structure and operation of liquid dispensing system 10, the reader is referred to U.S. Pat. No. 5,747,102, assigned to the common assignee, which is hereby incorporated by reference herein in its entirety.

Briefly, liquid dispensing system 10 includes a cup-shaped valve seat assembly 26 (FIG. 3) that is press fit, soldered or otherwise mounted within a lower end of flow bore 20 adjacent to the outlet end 24 of dispensing system 10. Valve seat assembly 26 has a flow passage 28 that fluidly communicates with the flow passage 22 extending through housing 18. An outlet opening 30 and associated valve seat 32 are formed on the lower end of valve seat assembly 26 for cooperation in known manner with a vertically reciprocal valve stem 34.

More particularly, valve stem 34 has a lower valve head 36 adapted for sealing engagement with valve seat 32 to normally close outlet opening 30. An opposite upper end (not shown) of valve stem 34 is engaged with a control mechanism 38 of dispensing system 10 for controlled, reciprocal movement of valve head 36 into and out of engagement with valve seat 32. With valve head 36 positioned in a retracted position away from valve seat 32 by operation of control mechanism 38, liquid or viscous material is permitted to flow through the outlet opening 30 of valve seat assembly 26 and through the outlet end 24 of dispensing system 10. While valve stem 34 is illustrated with a spherical valve head 36, it will be appreciated that other valve head shapes are possible without departing from the spirit and scope of the present invention. Also, while not shown, it will be appreciated that a heating element may be disposed adjacent valve seat assembly 26 for heating a small volume of liquid or viscous material in the valve seat assembly 26 as described in detail in U.S. Pat. No. 5,747,102 which is incorporated herein by reference.

Figure 2:
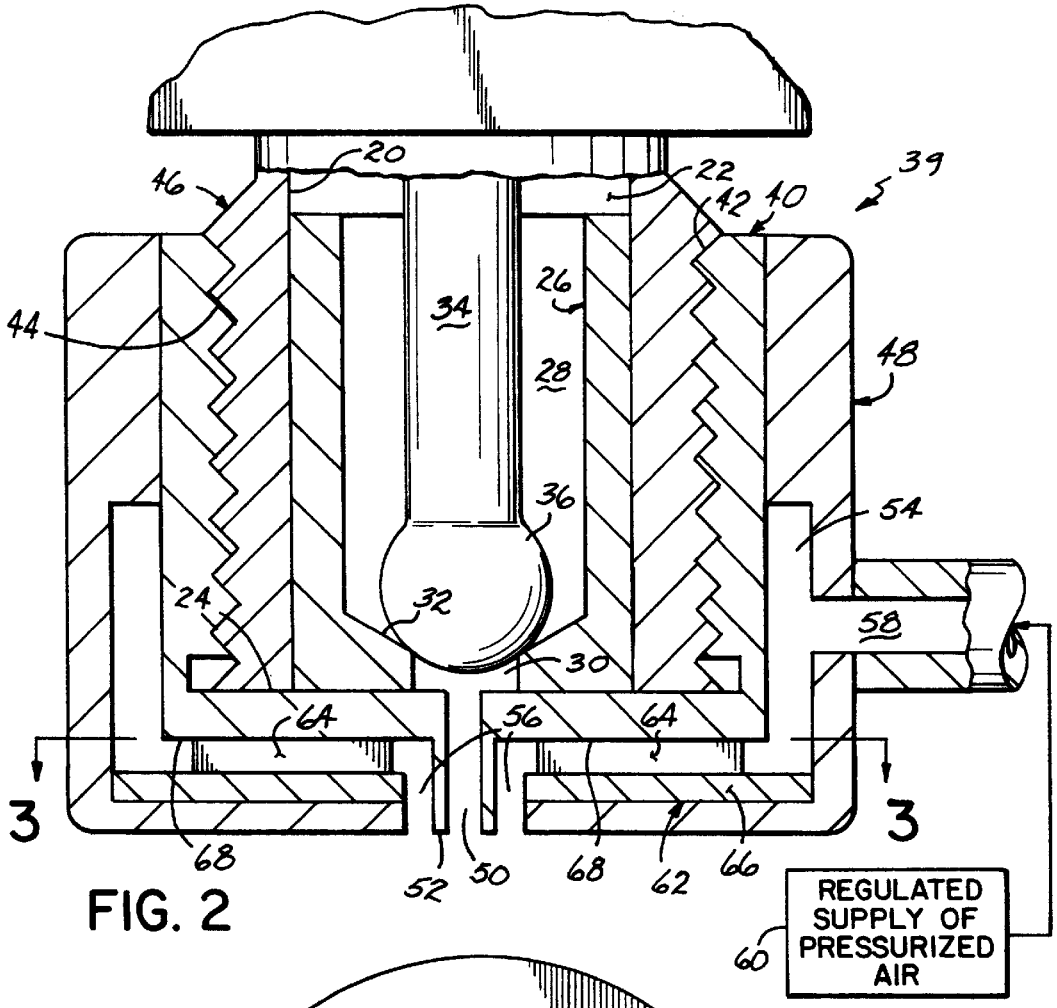
FIG. 2 is an enlarged partial cross sectional view of a nozzle assembly attached to the end of the liquid dispenser, taken along line 2—2 of FIG. 1.

A principle feature of the present invention relates to nozzle assembly 39 which is mounted in fluid communication with the outlet end 24 of liquid dispensing system 10. As shown in FIG. 2, nozzle assembly 39 includes a liquid dispensing nozzle body 40 having internal threads 42 for connection with external threads 44 of a dispenser body 46 associated with the dispensing system 10. Nozzle assembly 39 further includes an air discharge body 48 connected in surrounding relation to the liquid dispensing nozzle body 40 through conventional means such as epoxy adhesive or welding. While liquid dispensing nozzle body 40 and air discharge body 48 are shown as separate pieces, they may also be integrated into a single piece.

Still referring to FIG. 2, liquid dispensing nozzle body 40 has an internal liquid discharge passageway 50 which is in fluid communication with the flow passage 22 of dispensing system 10 through the outlet opening 30 of valve seat assembly 26. Liquid discharge passageway 50 extends through a nozzle tip 52 that extends away from the outlet end 24 of dispensing system 10 and is aligned along the longitudinal axis of dispenser body 46.

The air discharge body 48 has a plenum 54 disposed bout the liquid dispensing nozzle body 40 and an air discharge orifice 56. Plenum 54 and air discharge orifice 56 are in fluid communication with an air inlet passageway 58 that is operatively connected to a regulated supply of pressurized air 60.

Advantageously, the plenum 54 and air discharge orifice 56 are co-axially aligned with the liquid discharge passageway 50 extending through the nozzle tip 52 of liquid dispensing nozzle body 40. Preferably, the liquid discharge passageway 50 is disposed within and surrounded by the air discharge orifice 56 so that the air discharge orifice 56 is an annular orifice that surrounds the liquid discharge passageway 50. The annular air discharge orifice 56 may be continuous or uninterrupted about liquid discharge passageway 50 or, alternatively, it may include one or more interruptions.

Figure 3:
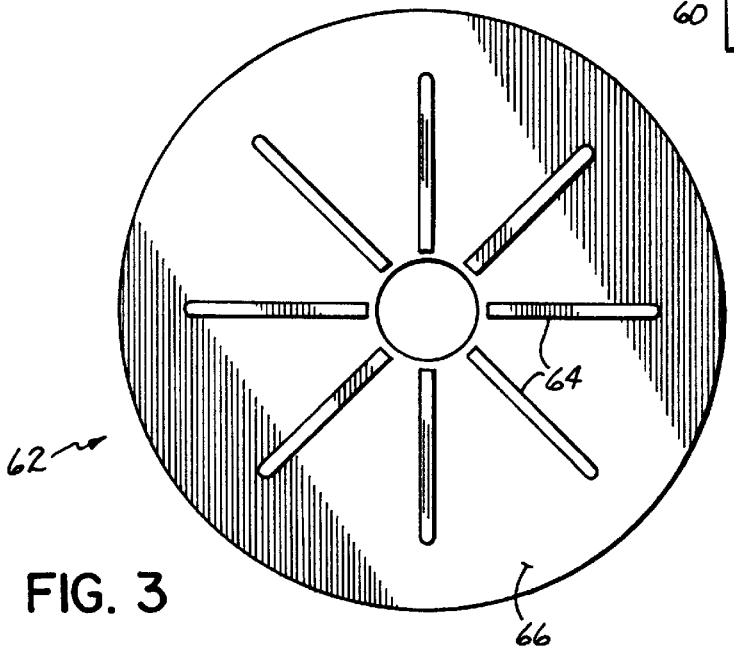
FIG. 3 is a top view taken along line 3—3 of the disk of FIG. 2.

As shown in FIGS. 2 and 3, a disk 62 may be inserted into the plenum 54 of air discharge body 48 that includes multiple radially extending vanes 64 that are circumferentially spaced equidistantly within the plenum 54. The vanes 64 extend from a planar wall 66 of disk 62 to substantially engage a planar shoulder 68 of the liquid dispensing nozzle body 40. The vanes 64 function to straighten and develop a streamlined flow of pressurized air through the plenum 54 prior to being discharged through the air discharge orifice 56 as described in detail below.

As best understood with reference to FIGS. 4A–4B, operation of liquid dispensing system 10 will now be described for forming droplets 12 of liquid or viscous material onto substrate 14. Droplets 12 may be solder flux, surface mount adhesive, chip underfill, epoxy or other liquid or viscous material used in the assembly or packaging of electronic components.

The dispensing method and dispensing apparatus contemplated by the present invention begins by positioning the liquid dispensing system 10 to a predetermined X-Y position relative to substrate 14, and setting the nozzle tip 52 to a predetermined Z position above substrate 14. For dispensing adhesives, the nozzle tip 52 may be set at about 2.0 mm or more above a top surface of the substrate 14. Prior to a dispensing cycle, a regulated supply of pressurized air from air supply 60 is provided to plenum 54 of air discharge body 48. The pressurized air is then discharged through the annular air discharge orifice 56 as a sheath 70 (FIGS. 4A–4B) of pressurized air that extends generally to the top surface of the substrate 14. The sheath 70 of pressurized air may be continuous or uninterrupted about its circumference or, alternatively when the air discharge orifice is interrupted, the sheath may include discontinuous or bands of pressurized air streams that are arranged circumferentially to form the sheath 70.

Figure 4B:
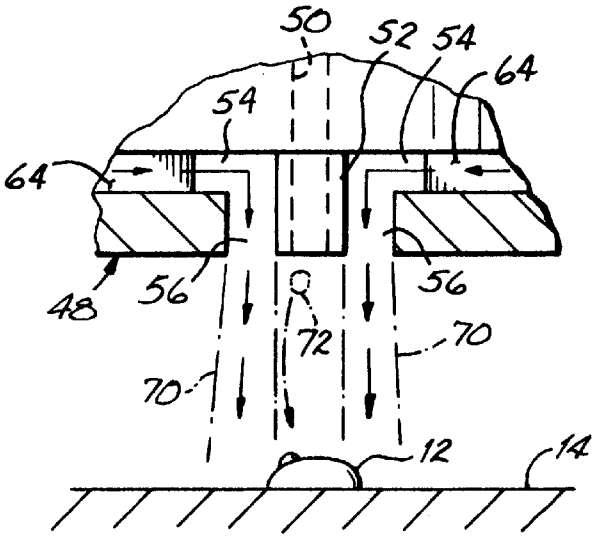
FIGS. 4A and 4B are diagrammatic views illustrating the liquid dispensing system of FIG. 1 dispensing a droplet of liquid material onto a substrate.
Figure 4A:
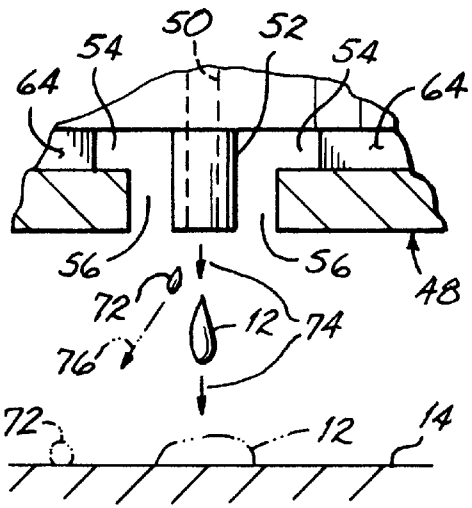

During a dispense cycle for forming a single liquid material droplet 12 as shown in FIGS. 4A–4B, the valve stem 34 is retracted from valve seat 32 to allow a small amount of liquid material to flow through liquid discharge passageway 50 for a pre-selected amount of time. After the pre-selected amount of time of fluid flow has expired, valve stem 34 is returned to the closed position to dispense the droplet 12 of liquid material from the nozzle tip 52 predominantly by the pressure exerted by valve head 36 returning into sealing engagement with valve seat 32. As the droplet 12 exits the nozzle tip 52, one or more satellites portions 72 associated with the droplet 12 may be formed. While the droplet 12 generally travels in flight toward the substrate 14 in a direction, indicated generally by arrows 74, that is generally aligned with dispensing axis of the dispensing system 10, the satellite portions 72 have a tendency to stray or deviate from the dispensing axis, as indicated generally by arrows 76. It will be appreciated that the stray satellite portions 72 can become problematic when they hit the substrate outside of the area of the dispensed droplet 12. These satellite portions 72 may fall within areas of the substrate 14 where it is undesirable to have a coating of viscous or liquid material. Further, the satellite portions 72 may adversely affect the uniformity of the material coating applied to the substrate 14.

In accordance with the method and dispensing apparatus of the present invention, as shown in FIG. 4B, the sheath 70 of pressurized air is discharged to substantially surround the droplet 12 and its associated satellite portions 72 during their flight toward the substrate 14. In this way, the satellite portions 72 that have a tendency to stray from the dispensing axis are contained within the sheath and prevented from contacting the substrate 14 in undesirable areas. The sheath 70 of pressurized air may cause the satellite portions 72 to merge with the dispensed droplet 12 as shown in FIG. 48. With the sheath 70 of pressurized air containing the satellite portions 72, the dispense height of nozzle tip 52 may be set at or above 2.00 mm, while still achieving accurate and repeatable dot formations on the substrate.

Thus, those skilled in the art will readily appreciate that the liquid dispensing system 10 of the present invention is particularly adapted for forming droplets of material and dispensing those droplets onto a substrate in an accurate and repeatable manner. With the sheath of pressurized air surrounding the droplet and its associated satellite portions during flight toward the substrate, better control of the dot shape and application of the dots toward the substrate is achieved. Further, the method and dispensing apparatus of the present invention permit higher dispense heights than previously achieved by known material dispensing systems, thereby allowing greater material coverage on the substrate with fewer dots.

While the present invention has been illustrated by a description of various preferred embodiments and while these embodiments have been described in considerable detail in order to describe the best mode of practicing the invention, it is not the intention of applicant to restrict or in any way limit the scope of the appended claims to such detail. Additional advantages and modifications within the spirit and scope of the invention will readily appear to those skilled in the art. The invention itself should only be defined by the appended claims, wherein I claim:

What is claimed is:

1. A method for dispensing a plurality of droplets of viscous liquid material in sequence with each droplet tending to separate into a droplet and at least one satellite portion during flight toward a substrate using a dispenser having a liquid discharge passageway in fluid communication with a source of viscous liquid and an air discharge passage in fluid communication with a source of pressurized air, comprising:

dispensing the plurality of droplets of viscous liquid in sequence from the liquid discharge passageway in a travel path substantially transverse to the substrate;

discharging pressurized air as a sheath from the air discharge passage in a direction substantially parallel to the travel path of the droplets; and substantially surrounding each dispensed droplet and the satellite portion associated therewith with the discharged sheath of pressurized air during flight toward the substrate so that the satellite portion is contained within the sheath of pressurized air.

2. Apparatus for dispensing a plurality of droplets of viscous liquid material in sequence with each droplet tending to separate into a droplet and at least one satellite portion during flight toward a substrate, comprising:

a dispenser body having a liquid supply passageway adapted to connect to a source of the viscous liquid; and a nozzle assembly connected to said dispenser body and having a liquid discharge passageway in fluid communication with said liquid supply passageway of said dispenser body for dispensing the plurality of droplets of viscous liquid material in sequence in a travel oath substantially transverse to the substrate, and an air discharge orifice adapted to connect to a source of pressurized air and being configured and located with respect to said liquid discharge passageway to discharge pressurized air as a sheath in a direction substantially parallel to the travel path of the droplets that substantially surrounds each dispensed droplet and the satellite portion associated therewith during flight toward the substrate so that the satellite portion is contained within said discharged sheath of pressurized air.

3. The apparatus of claim 2, wherein said liquid discharge passageway and said air discharge orifice are co-axially aligned with one another, and further wherein said air discharge orifice is an annular orifice surrounding said liquid discharge passageway.

4. The apparatus of claim 3, wherein said annular orifice is uninterrupted surrounding said liquid discharge passageway.

5. The apparatus of claim 2, wherein said nozzle assembly includes a liquid dispensing nozzle body having said liquid discharge passageway, and an air discharge body operatively connected to said liquid dispensing nozzle body and having said air discharge orifice.

6. The apparatus of claim 5 wherein said air discharge body has a plenum connected to said air discharge orifice.

7. The apparatus of claim 6 wherein said air discharge body has a plurality of radially directed vanes disposed in said plenum for guiding pressurized air flow through said plenum.

8. The apparatus of claim 4, wherein said liquid dispensing nozzle body and said air discharge body are integral.

9. A nozzle assembly for dispensing a plurality of droplets of viscous liquid in sequence with each droplet tending to separate into a droplet and at least one satellite portion during flight toward a substrate, comprising:

a liquid discharge passageway adapted to connect to a source of viscous liquid for dispensing the plurality of droplets of viscous liquid in sequence in a travel path substantially transverse to the substrate; and an air discharge orifice adapted to connect to a source of pressurized air and being configured and located with respect to said liquid discharge passageway to discharge pressurized air as a sheath in a direction substantially parallel to the travel path of the droplets that substantially surrounds each dispensed droplet and the satellite portion associated therewith during flight toward the substrate so that the satellite portion is contained within said discharged sheath.

10. The nozzle assembly of claim 9, wherein said liquid discharge passageway and said air discharge orifice are co-axially aligned with one another, and further wherein said air discharge orifice is an annular orifice surrounding said liquid discharge passageway.

11. The nozzle assembly of claim 10, wherein said annular orifice is uninterrupted surrounding said liquid discharge passageway.

12. The nozzle assembly of claim 9, wherein said nozzle assembly includes a liquid dispensing nozzle body having said liquid discharge passageway, and an air discharge body operatively connected to said liquid dispensing nozzle body and having said air discharge orifice.

13. The nozzle assembly of claim 12 wherein said air discharge body has a plenum connected to said air discharge orifice.

14. The nozzle assembly of claim 13 wherein said air discharge body has a plurality of radially directed vanes disposed in said plenum for guiding pressurized air flow through said plenum.

15. The nozzle assembly of claim 12, wherein said liquid dispensing nozzle body and said air discharge body are integral.

* * * * *

UNITED STATES PATENT AND TRADEMARK OFFICE

CERTIFICATE OF CORRECTION

PATENT NO. : 6,270,019 B1
DATED : August 7, 2001
INVENTOR(S) : Michael A. Reighard It is certified that error appears in the above-identified patent and that said Letters Patent is hereby corrected as shown below:

Column 5,
Line 14, change "bout" to -- about --.

Column 6,
Line 32, change "FIG. 48" to -- Fig. 4B --.

Column 7,
Line 23, change "in a travel oath" to -- in a travel path --.

Column 8,
Line 5, change "The apparatus of claim 4, wherein" to -- The apparatus of claim 5, wherein --.

Signed and Sealed this

Fourteenth Day of May, 2002

*Attest:*

*Attesting Officer*

JAMES E. ROGAN
*Director of the United States Patent and Trademark Office*